US011241853B2

(12) United States Patent
Olds

(10) Patent No.: US 11,241,853 B2
(45) Date of Patent: Feb. 8, 2022

(54) BALING MACHINE WITH CONTAINMENT APPARATUS

(71) Applicant: Sierra International Machinery, LLC, Jesup, GA (US)

(72) Inventor: Emory Olds, Cordele, GA (US)

(73) Assignee: Sierra International Machinery, LLC, Jesup, GA (US)

( * ) Notice: Subject to any disclaimer, the term of this patent is extended or adjusted under 35 U.S.C. 154(b) by 140 days.

(21) Appl. No.: 16/663,117

(22) Filed: Oct. 24, 2019

(65) Prior Publication Data

US 2020/0139656 A1 May 7, 2020

Related U.S. Application Data

(60) Provisional application No. 62/752,238, filed on Oct. 29, 2018.

(51) Int. Cl.
*B30B 9/30* (2006.01)

(52) U.S. Cl.
CPC ..... *B30B 9/301* (2013.01); *B30B 9/3014* (2013.01); *B30B 9/3021* (2013.01); *B30B 9/3078* (2013.01)

(58) Field of Classification Search
CPC ..... B30B 9/301; B30B 9/3007; B30B 9/3014; B30B 9/3021; B30B 9/3078
USPC ..... 100/215, 218, 240, 245
See application file for complete search history.

(56) References Cited

U.S. PATENT DOCUMENTS 1,967,845 A * 7/1934 Streun ..... D01B 1/04 222/503
4,594,942 A * 6/1986 Denneboom ..... B30B 9/301 100/137
5,001,975 A 3/1991 Finden
5,193,454 A * 3/1993 Bollegraaf ..... B30B 7/04 100/142
6,308,618 B1 10/2001 Richard et al.
6,823,776 B1 * 11/2004 Olds ..... B30B 9/3003 100/188 R
7,191,701 B2 * 3/2007 Fukuizumi ..... B30B 9/3053 100/215
8,240,247 B2 * 8/2012 Wincott ..... B30B 15/08 100/3

(Continued)

FOREIGN PATENT DOCUMENTS

EP 1029655 A2 8/2000
GB 2559155 B * 9/2019 ..... B30B 9/3078
WO WO 83/04192 A1 12/1983

OTHER PUBLICATIONS

International Search Report issued in application No. PCT/US2019/058150 dated Apr. 10, 2020.

(Continued)

*Primary Examiner* — Jimmy T Nguyen

(74) *Attorney, Agent, or Firm* — Knobbe, Martens, Olson & Bear, LLP

(57) ABSTRACT

A baling machine including a gathering ram and a hopper with a charging chamber is disclosed. The hopper can include a pair of flat doors and an actuator that can move the flat doors to apply compression force to material placed in the hopper. The compression force applied by the flat doors can improve efficiency of the baling machine by increasing the amount of the material compacted by each stroke of the gathering ram.

20 Claims, 11 Drawing Sheets

(56) References Cited

U.S. PATENT DOCUMENTS

| | | | | |
|---|---|---|---|---|
| 2007/0028787 | A1* | 2/2007 | Olds | B30B 9/3078 100/240 |
| 2009/0181117 | A1 | 7/2009 | Bouldin | |

OTHER PUBLICATIONS

Written Opinion issued in application No. PCT/US2019/058150 dated Apr. 10, 2020.

* cited by examiner

BALING MACHINE WITH CONTAINMENT APPARATUS

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57 and should be considered a part of this specification.

BACKGROUND OF THE INVENTION

Field

The present invention relates to a baling apparatus or machine for baling a wide range of recyclable materials such as, but not limited to, fiber, paper, old corrugated containers, cardboard, plastic, scrap metals, non-ferrous metals, municipal solid waste into a bale for easier transport and, in particular, concerns a containment apparatus that is improves efficiency of the baling machine and the baling process.

Description of the Related Art

Material waste processing such as scrap metal processing is a well-known form of processing. Generally, bulk quantities of scrap material, such as scrap metal are positioned into a rectangular chamber and are then compressed into a bale shape by a hydraulic ram. In this way, discrete pieces of materials are then formed into a cohesive element that is easier to store and to transport for further processing.

Typically, a horizontal baler has a hopper into which the material is deposited. The hopper then feeds into an opening that leads to the compression chamber. The compressing ram then travels into the compression chamber sealing off the opening and the hopper. Typically, the compressing ram and the edge of the opening adjacent the compression chamber define a cutting apparatus that cuts through material that extends out of the opening into the hopper. However, the cutting apparatus can wear out over time and make the baling process less efficient and requiring maintenance.

Another difficulty that occurs with horizontal waste processing baling machines is containment of the material in the compression chamber during the baling process. For example, when compressing soft materials such as cotton, the compressing ram travelling into the compression chamber can cause the material to "ride-up" and come out from the compression chamber and back into the hopper section above it. In another example, materials such as metal scraps can be stuck to the walls of the hopper (e.g., "bridging") and not enter the compression chamber.

SUMMARY

Accordingly, there is a need for a design for baling machines that can provide improved containment of materials, improved baling efficiency, and longer lifespan of the cutting apparatus. In accordance with one aspect, a baling machine having a charging chamber with one or more containment members is provided, thereby providing a compression force that can contain material in the charging chamber during actuation of the compression or gatherer ram. In accordance with one aspect, a baling machine has a hopper that defines an opening in communication with a charging chamber below the hopper. The machine has a pair of pivotable doors, each having a substantially planar surface. The pair of doors configured to move between a retracted position and a deployed position. In the retracted position, the pair of doors are generally upright (e.g., vertical) define at least a portion of the sidewalls of the hopper, allowing communication between the opening and the charging chamber. In the deployed position, the pair of doors are generally horizontal (e.g., perpendicular to a central axis of the hopper) and apply a compression force to material introduced through the hopper into the charging chamber. In the deployed position, the pair of doors contain material in the charging chamber during actuation of the compression or gatherer ram. Advantageously, the pair of doors of the containment apparatus inhibit (e.g., prevent) the ride-up of material from the charging chamber into the hopper, and inhibit (e.g. prevent) bridging of material above the charging chamber (e.g., because the doors force such material down into the charging chamber as the doors are pivoted from the retracted to the deployed position).

In accordance with one aspect, a baling machine is provided. The baling machine can include a baling ram assembly, an ejector ram assembly, a charging chamber, and a compaction chamber. The charging chamber can include an opening whereby various materials can be introduced to the charging chamber. The charging chamber can include one or more containment members that are configured to provide compression force to push down and contain the material placed in the charging chamber. The containment members can be hingedly coupled to the hopper and have a first position and a second position. When the containment members are in the first position, first surfaces of the containment members can be flush with an inner surface of the hopper. When the containment members are in the second position, the first surfaces of the containment members can be substantially perpendicular with sidewalls of the charging chamber or parallel with a bottom surface of the charging chamber. Optionally, the containment members have a third position where the first surface of the containment members is beyond an upper boundary of the charging chamber.

In accordance with one aspect, a method of baling a material is provided. The method can include placing material in a hopper of a baling machine. The method can include actuating a containment apparatus to cause one or more containment members to apply a first compression force to the material in the hopper. The method can include actuating a baling or gatherer ram to apply a second compression force, to the material in a charging chamber. The method can include actuating an ejecting ram to eject a bale from a compacting or bale chamber. Optionally, the direction of the compression force applied by the containment members can be orthogonal to a plane defined by a bottom surface of the charging chamber.

DETAILED DESCRIPTION

Introduction

Figure 1A:
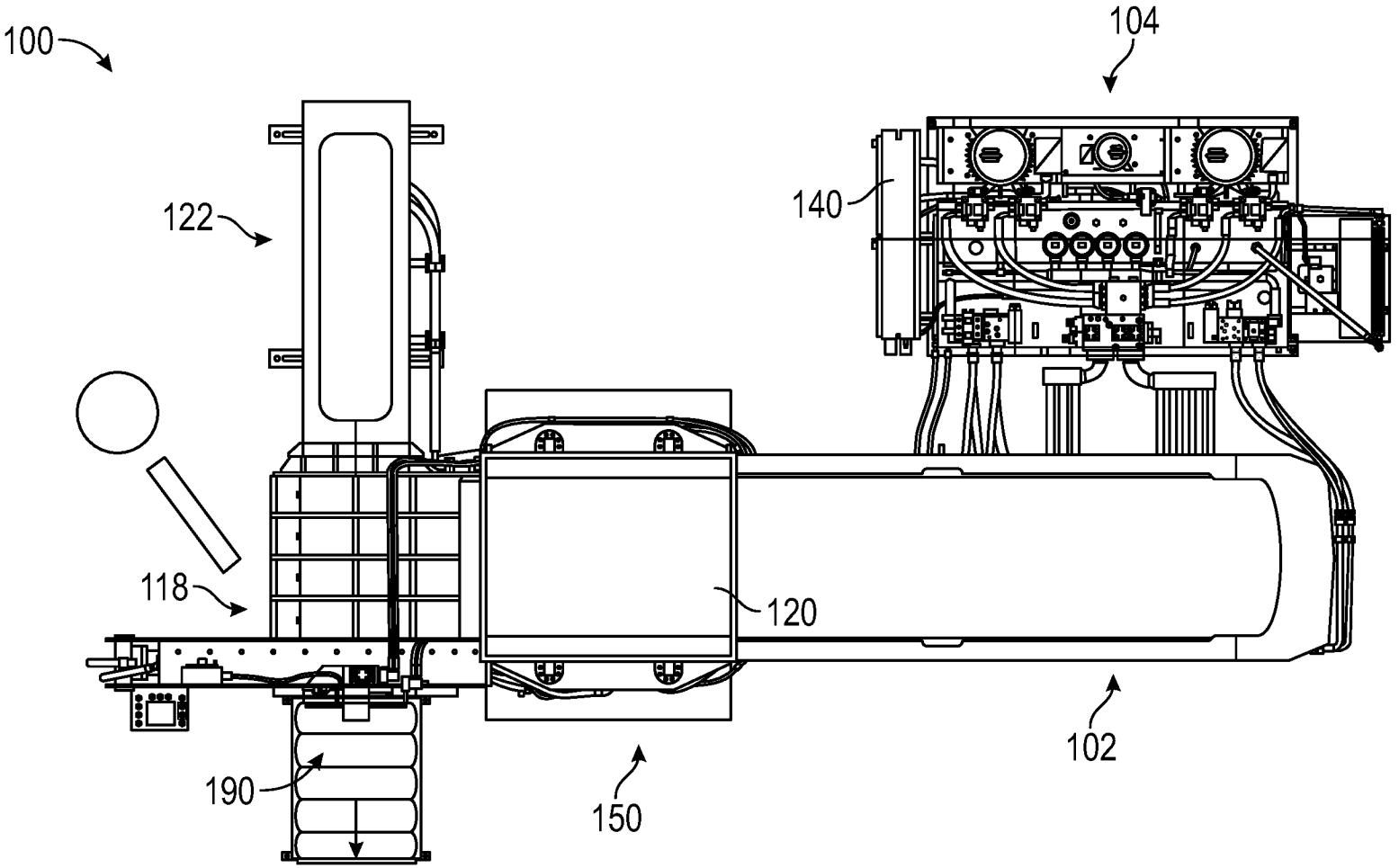
FIG. 1A is a top view of a baling machine with a containment apparatus.
Figure 1B:
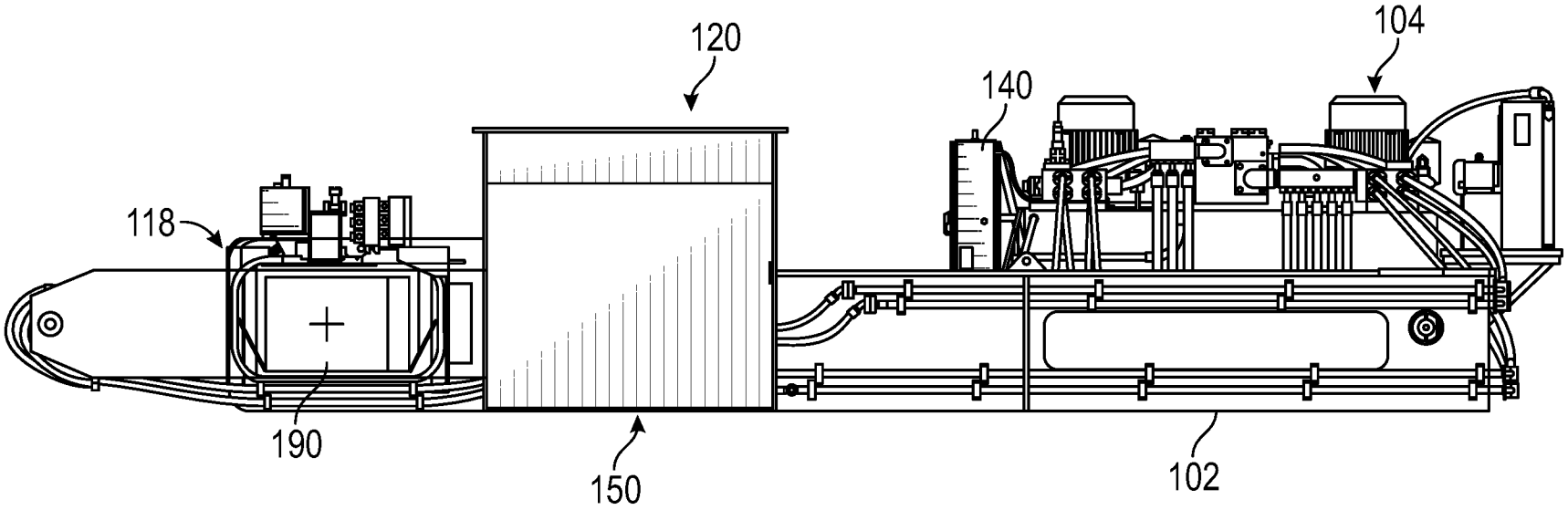
FIG. 1B is a side view of the baling machine of FIG. 1A.
Figure 1C:
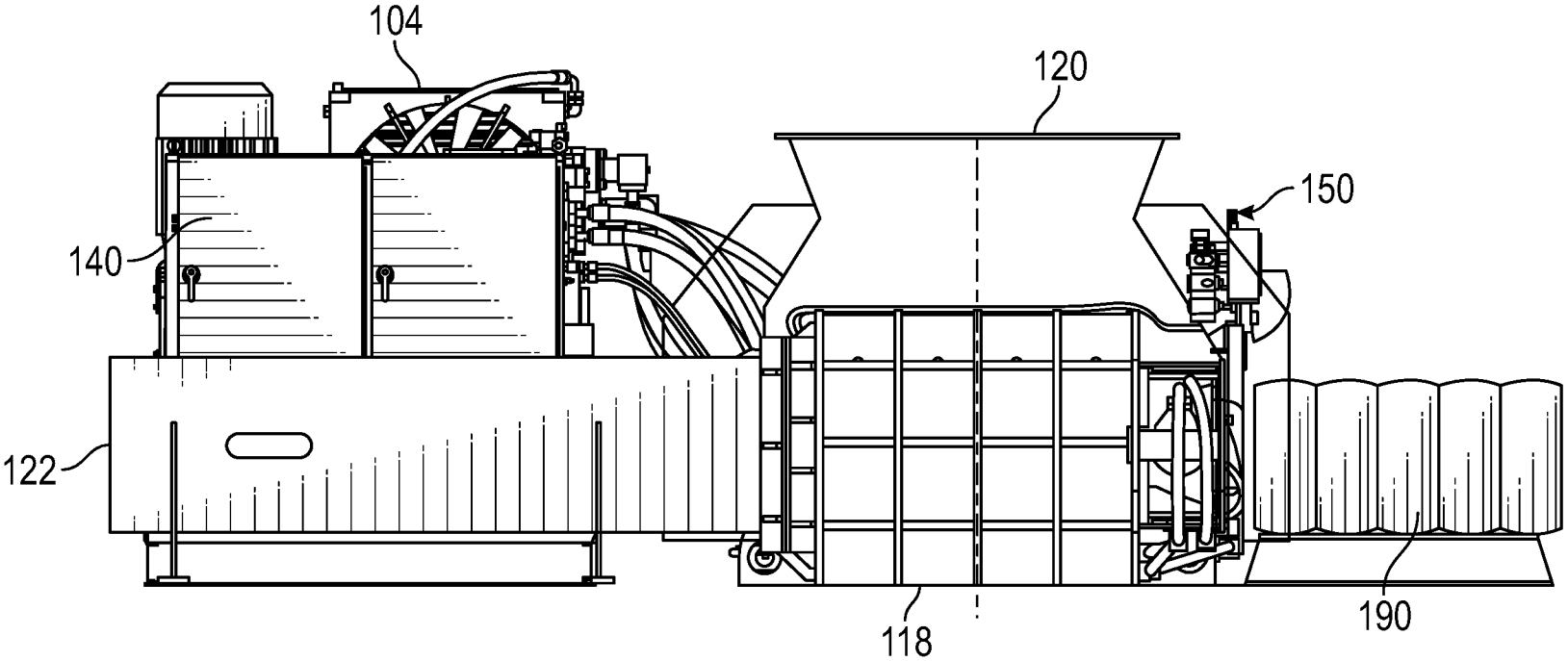
FIG. 1C is an end view of the baling machine of FIG. 1A.

Reference will now be made to the drawings wherein like numeral refer to the like parts throughout. FIGS. 1A-1C illustrate simplified illustrations of a baling machine 100. As shown, the baling machine 100 can include a baling ram assembly 102, a power unit 104, a hopper 150, a compaction (or bale) chamber 118, an ejector ram assembly 122, a control system 140, and an exit 190.

The control system 140 can be operatively connected to the baling ram assembly 102 and the ejector ram assembly 122 to allow signals be transmitted between the control system 140 and the baling ram assembly 102 and the ejector ram assembly 122. The control system 140 can be operatively connected to the power unit 104 such that the control system 140 can transmit electronic signals to the power unit 104, which can be operatively connected to the baling ram assembly 102 and the ejector ram assembly 122. By transmitting signals to controlling the power unit 104, the control system 140 can control operations of the baling ram assembly 102 and the ejector ram assembly 122.

The baling ram assembly 102 can be connected to the hopper 150. As shown in FIG. 1B, the hopper 150 can include a charging chamber 116 and an opening 120 whereby material 250 (for example, materials such as scrap metal, plastic, cotton, cardboard, fiber products, paper, old corrugated containers, non-ferrous metals, municipal solid waste, and the like) can be introduced into the charging chamber 116 (see FIG. 1D). Optionally, the hopper 150 is a separate component disposed above the charging chamber 116. The baling ram assembly 102 can be coupled to the charging chamber 116 such that a portion of the baling ram assembly 102 defines at least a portion of a wall of the charging chamber 116.

The charging chamber 116 can be in communication with the compaction chamber 118 such that the charging chamber 116 and the compaction chamber 118 can define a cavity with a first cross-section. The charging chamber 116 can be interposed between the baling ram assembly 102 and the compaction chamber 118. The material 250 placed through the opening 120 of the hopper 150 and placed in the charging chamber 116 may be compressed and pushed into the compaction chamber 118 by the baling (or gatherer) ram 108. The material 250 compacted by the baling ram 108 becomes a bale 254. The bale 254 can have the approximate dimensions as the compaction chamber 118. The charging chamber 116 and the compaction (or bale) chamber 118 can have the same or different dimensions.

The ejector ram assembly 122 can be coupled to the compaction chamber 118 such that a portion of the ejector ram assembly 122 can form at least a portion of the wall of the compaction chamber 118. After the baling ram assembly 102 compresses or compacts the material 250 in the charging chamber 116 to form the bale 254 in the compacting chamber 118, the ejector ram 128 can eject the bale 254 from the compaction (or bale) chamber 118 via the exit 190.

Figure 1D:
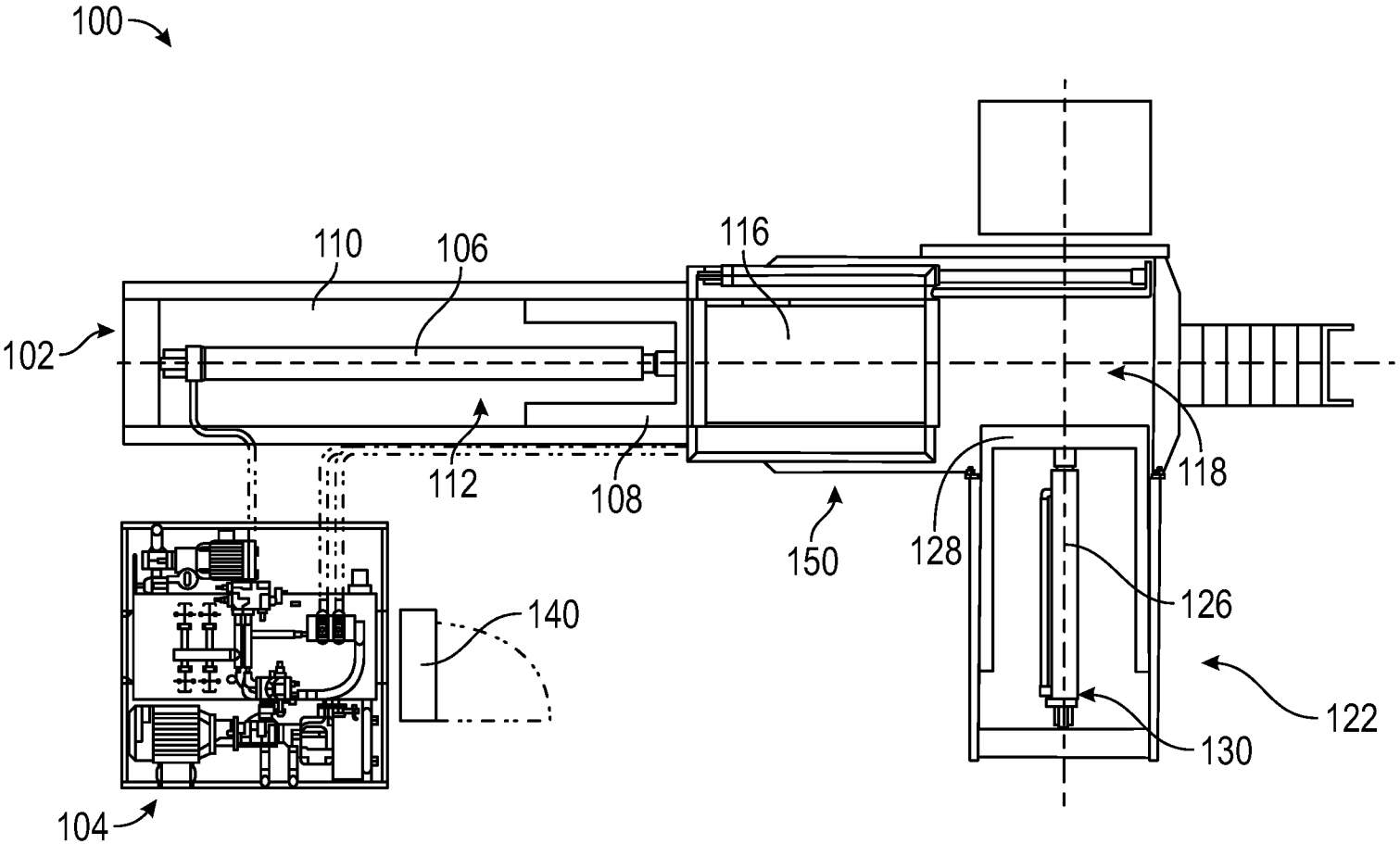
FIG. 1D is a top view of a baling machine similar to the baling machine of FIG. 1A, showing additional details of a baling or gatherer ram assembly and an ejector ram assembly of the baling machine.

FIG. 1D illustrates additional details of the baling ram assembly 102 and the ejector ram assembly 122. The baling ram assembly 102 can include an opening 110 (e.g. cylinder), a baling actuator 106, and a baling ram 108. The opening 110 (e.g., cylinder) can define a path of travel of the baling (or gatherer) ram 108. The opening 110 can be divided into different sections. For example, one section can include a main ram travel section 112 wherein the baling actuator 106 is located, while another section of the opening 110 (e.g., cylinder) can be the charging chamber 116 positioned adjacent the main ram travel section 112.

The baling actuator 106 can cause the baling (or gatherer) ram 108 to travel toward and away from the charging chamber 116 such that the baling ram 108 moves across the charging chamber 116. As discussed above, the actuation of the baling actuator 106 and subsequent movement of the baling ram 108 can compress the material 250 located inside the charging chamber 116 into the bale 254. Optionally, it may take more than one compression cycle for the baling ram 208 to compress the material into the bale 254. In one example, it may take four strokes for the baling ram 208 to compress the material into the bale 254. Once the baling ram 108 has compressed the material into the bale 254, the baling actuator 106 can retract the baling ram 108 so that it moves away from the bale and past the charging chamber 116 back into the proximal portion of the opening 110 (or cylinder), allowing additional material to enter the charging chamber 116 via the hopper 120. The baling actuator 106 can then be actuated again to move forward and compress the material into another bale 254.

The ejector ram assembly 122 can include an opening 130 (e.g., cylinder), an ejector actuator 126, and an ejector ram 128. The opening 130 (e.g., cylinder) of the ejector ram assembly 122 can be generally transverse or orthogonal (e.g., perpendicular) to the opening 110 (e.g., cylinder) of the baling ram assembly 102. The opening 130 can define a path of travel of the ejector ram 128. The ejector ram 128 can divide the opening 130 into sections. For example, the ejector ram 128 can define an ejector ram travel section 132 wherein the ejector actuator 126 is located and the compaction (or bale) chamber 118 positioned adjacent the ejector ram travel section.

The ejector ram assembly 122 can be positioned such that the baling ram assembly 102 and the ejector ram assembly 122 are substantially perpendicular with respect to each other. Optionally, the ejector ram assembly 122 and the baling ram assembly 102 can form an angle, where the angle can be between about 20 degrees and about 160 degrees, between about 30 degrees and about 150 degrees, between about 40 degrees and about 140 degrees, between about 50 degrees and about 130 degrees, between about 60 degrees and about 120 degrees, between about 70 degrees and about 110 degrees, between about 80 degrees and about 100 degrees, or about 20 degrees, about 30 degrees, about 40 degrees, about 50 degrees, about 60 degrees, about 70 degrees, about 80 degrees, about 90 degrees, about 100 degrees, about 110 degrees, about 120 degrees, about 130 degrees, about 140 degrees, about 150 degrees, about 160 degrees, or between a range of any two of the aforementioned values.

As discussed above, the baling ram 108 can be generally sized so as to have approximately the same cross-sectional area as the opening 110. When the baling ram 108 is actuated by the baling actuator 106, the baling ram 108 can travel across the charging chamber 116 to compress material disposed within the charging chamber 116. Some examples of materials that can be compressed into a bale by the baling machine 100 include, but not limited to, scrap metal, plastic, cotton, cardboard, carpet, cans, fiber products, paper, old corrugated containers, non-ferrous metals, municipal solid waste and the like.

Figure 2A:
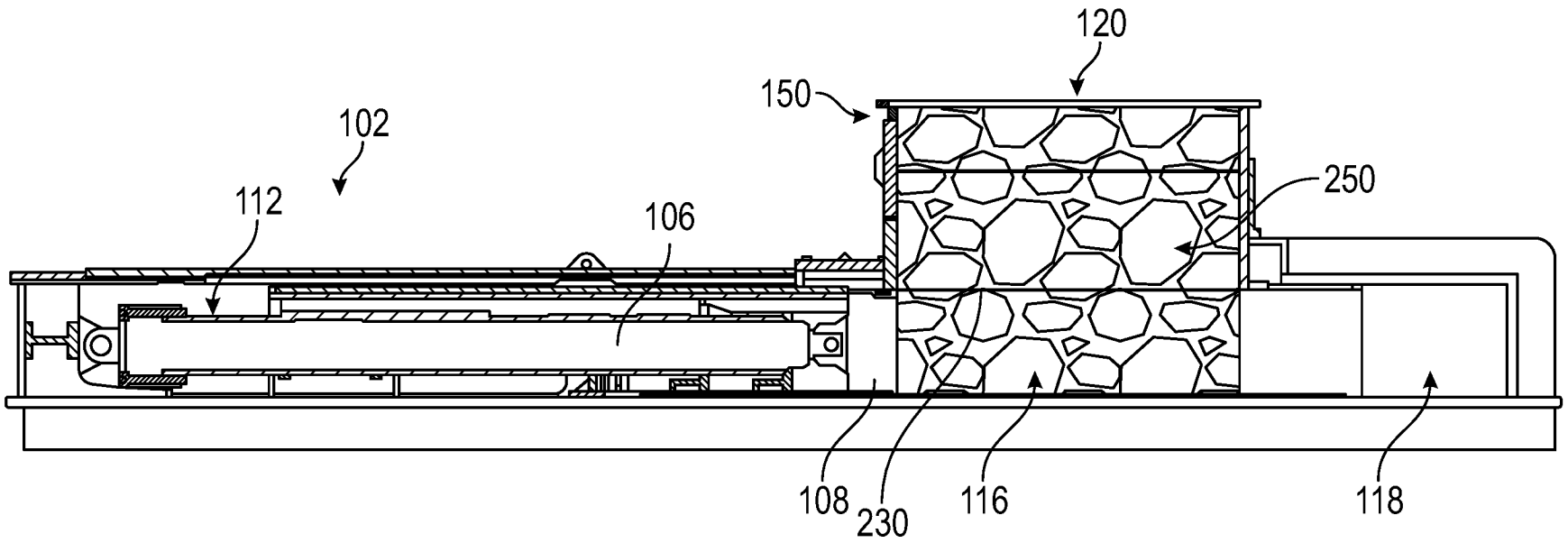
FIGS. 2A and 2B illustrate cross-sectional side and end views of the baling machine of FIG. 1A, showing a material hopper and a charge chamber of the baling machine filled with a material in an un-compressed state.

FIG. 2A illustrates a cross-sectional view of the baling ram assembly 102, the hopper 150, and the compaction chamber 118. As shown in FIG. 2A, the material 250 can be placed in the hopper 150 through the opening 120. The material 250 can fill at least a portion of the volume of the hopper 150 or fill the entire volume of the hopper 150. The material 250 can occupy at least a portion or the entire volume of the charging chamber 116.

The cross-section of the charging chamber 116 can correspond to the surface area of the baling ram 108 of the baling ram assembly 102. The baling ram 108 can define one of the sides of the charging chamber 116. The charging chamber 116 can have an upper boundary 230 associated to a volume of the material 250 to be compressed by the baling ram 108. The baling ram 108 of the baling ram assembly 102 may not compress the material 250 positioned above the upper boundary 230.

Containment Apparatus

Figure 2B:
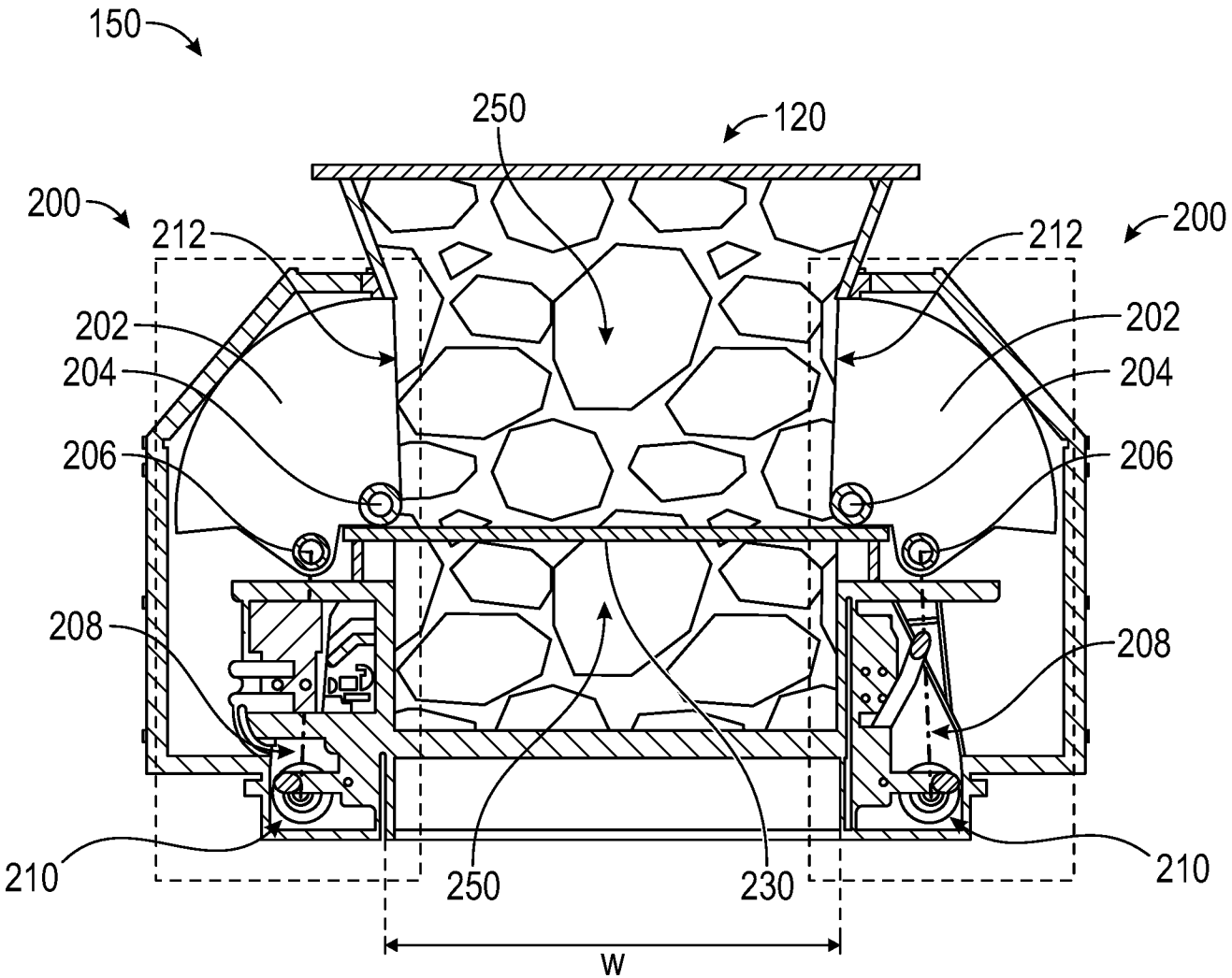

Referring now to FIGS. 2B-4B, a containment apparatus 200 will now be described in greater detail. FIG. 2B illustrates a cross-sectional view of the hopper 150 filled with the material 250. The hopper 150 can include one or more containment apparatus 200 as shown in FIG. 2B. The containment apparatus 200 can include a containment member 202, an actuating member 208, and an actuator 210. The containment member 202 can include a first connector 204, a second connector 206, and a first surface 212. In the illustrated embodiment, the containment member 202 is a pivotable door 202 and the containment apparatus 200 includes a pair of pivotable doors 202.

The first surface 212 can form an inner surface of the hopper 150 when the containment members 202 are in a first position (e.g., generally upright, such as vertical, position). The first surface 212 may be configured and dimensioned to be flush with the inner surface of the hopper 150. The first surface 212 may be substantially planar (e.g., flat). Optionally, the first surface 212 can be convex or concave. Optionally, the first surface 212 can be treated (e.g., have a coating thereon) to prevent the material 250 from sticking to the first surface 212.

The first connector 204 (e.g., hinge joint) can rotatably couple the containment member 202 to the hopper 150 such that the containment member 202 can rotate about the first connector 204 towards the charging chamber 116. The second connector 206 can be operatively connected to the actuator 210 via the actuating member 208 such that the actuator 210 can linearly or angularly actuate the containment member 202. For example, actuator 210 can actuate the actuating member 208 and move the second connector 206 away from the actuator 210, causing the containment member 202 can rotate about the first connector 204. Optionally, the containment members 202 may not be rotatably coupled to the hopper 150. The containment member 202 can be coupled to the hopper 150 such that the containment member 202 can move in various linear directions. For example, the containment member 202 may be slidably coupled to the hopper 150.

The actuator 210 can be a hydraulic actuator, pneumatic actuator, magnetic actuator, electronic actuator, mechanical actuators (e.g., gear assembly), or the like. The actuator 210 can be linear or angular actuator. The actuating member 208 can be a guide wire, a piston, or the like. Optionally, the power unit 104 and the control system 140 can be operatively connected to the actuator 210 such that the control system 140 and the power unit 104 can send signals to the actuator 210 and control operation of the actuator 210.

The actuator 210 can cause the containment member 202 of the containment apparatus 200 to move between a first position (e.g., where the surface 212 is generally upright, such as vertical, position) and a second position (e.g., where the surface 212 is generally horizontal, such as transverse to a central axis of the hopper 120). Optionally, the actuator 210 can cause the containment member 202 to move between the first position, the second position, and a third position (e.g., an angular position between a first vertical position and a second horizontal position). Optionally, the actuator 210 can move the containment member 202 incrementally between different positions. The control system 140 can send signals to the actuator 210 to move the containment member 202 between any of the positions (for example, the first position and the second position) described above.

Operation

Figure 3A:
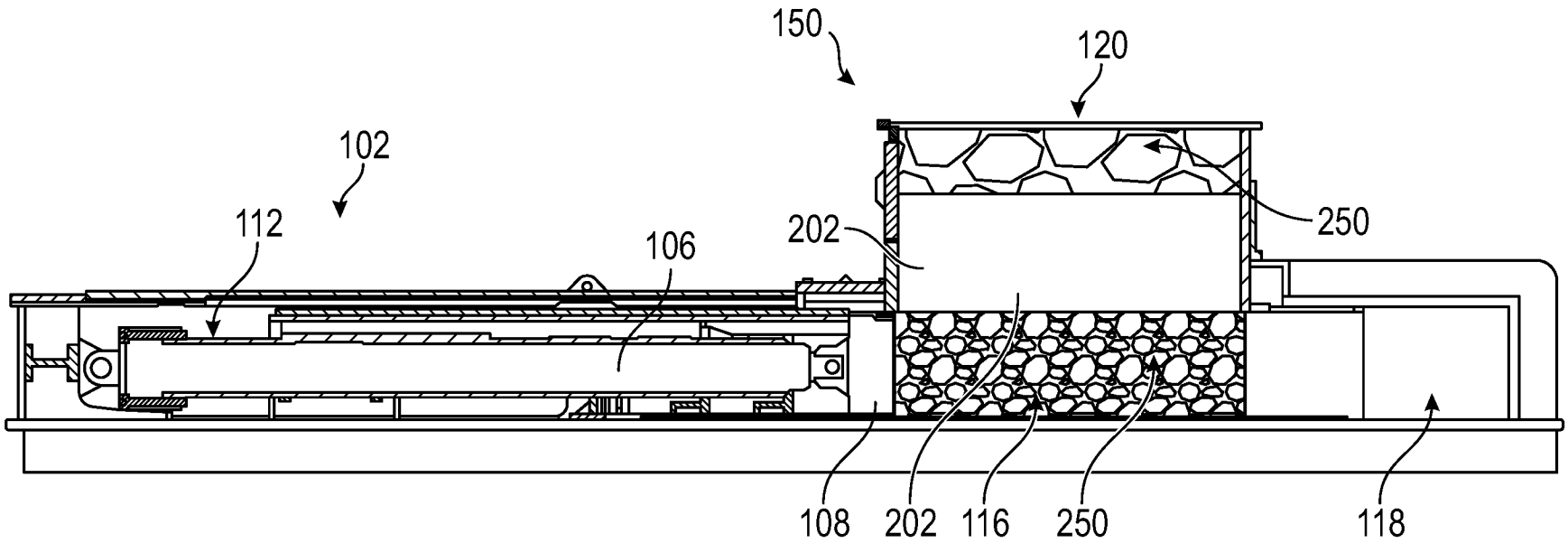
FIGS. 3A and 3B illustrate cross-sectional side and end views of the baling machine of FIG. 1A, showing the material compressed in the charge chamber.
Figure 3B:
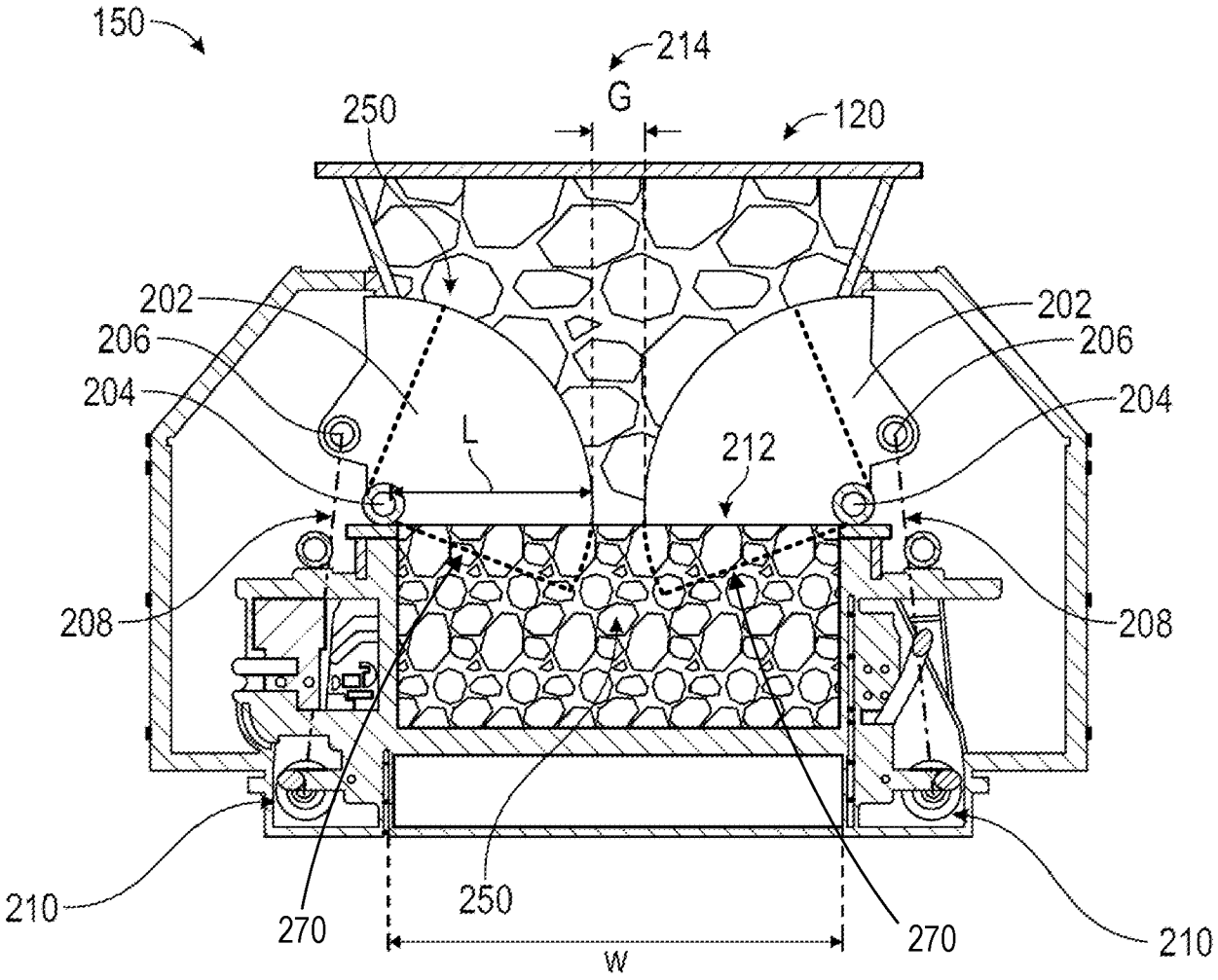

As noted above, the containment member 202 can have a multiple configurations as shown in FIGS. 2B and 3B. When the containment member 202 is in the first position, the first surface 212 can be flush with an inner surface of the hopper 150, as shown in FIG. 2B. When in the first position, the first surface 212 of the containment member 202 may not interfere with hopper 150. For example, the first surface 212 can be substantially vertical when the containment member 202 is in the first position. Optionally, the first surface 212 can be flush with the inner surface of the hopper 150.

The containment member 202 can have the second position. FIGS. 3A and 3B illustrate various side views of the hopper 150 with the containment members 202 in the second position. The first and the second positions can describe angular or linear positions of the containment member 202. FIG. 3B illustrates an example of the containment members 202 in the second position where the second position of the containment members 202 is about 90 degrees from the first position (FIG. 2B).

When the containment member 202 is in the second position, the first surface 212 can be substantially perpendicular to the sidewalls of the charging chamber 116. Optionally, the first surface 212 can be substantially parallel to a bottom surface of the charging chamber 116 when the containment member 202 is in the second position. As shown in FIG. 3B, the first surfaces 212 of the containment members 202 can be substantially parallel to the bottom surface of the charging chamber 116.

The containment members 202, when in the second position, can form a gap 214 (denoted by "G"). The gap 214 can prevent the containment members 202 and the first surfaces 212 from contacting each other and be damaged during operation. The gap 214 can prevent jamming of the containment members 202 (e.g., having the doors 202 seize against each other). The size of the gap 214 (distance between the first surfaces 212) can be between about 2% or about 10% of the width of the charging chamber ("W" in FIG. 3B), between about 3% and about 9% of W, between about 4% and about 8% of W, between about 5% and about 7% of W, or 2%, 3%, 4%, 5%, 6%, 7%, 8%, 9%, or 10% of W, or range between any two of the aforementioned values. Optionally, the size of the gap 214 can be between about 2% or about 10% of a length of the first surface ("L" in FIG. 3B), between about 3% and about 9% of L, between about 4% and about 8% of L, between about 5% and about 7% of L, or 2%, 3%, 4%, 5%, 6%, 7%, 8%, 9%, or 10% of L, or range between any two of the aforementioned values.

The containment apparatus 200 can be advantageous for operations of the baling machine 100 for several reasons. For example, as discussed above, some materials can "ride up" when the baling ram 108 compresses the material 250 by moving across the charging chamber 116. By applying compression force to the material 250, the containment member 202 of the containment apparatus 200 can advantageously prevent the material "ride-up."

The containment apparatus 200 can advantageously improve baling efficiency of the baling machine 100. When the containment members 202 move from the first position to the second position, they can apply pressure to and push the material 250 located above the upper boundary 230 towards the charging chamber. This can advantageously increase the amount of the material 250 in the charging chamber 116 prior to the baling ram 108 moving across the charging chamber 116. For example, when the containment members 202 are in the second position (as opposed to the first position), the charging chamber 116 stores about 75% more of the material 250. This indicates that the baling machine 100 can advantageously compress about 75% more of the material 250 each time the baling ram 108 moves across the charging chamber 116. This can improve efficiency of the baling machine 100 by reducing the number of strokes needed by the baling ram assembly 102 to form a bale 254 (e.g., reducing from 12 strokes to about 4 strokes or less), and thereby the amount of energy needed to bale the material.

In addition, the containment apparatus 200 can be advantageous in preventing "bridging" of the material 250 in the hopper 150. For example, materials such as cardboard or elongate metal or plastic pieces can be lodged between the walls of the hopper and cause "bridging." By moving from the first position to the second position, the containment member 202 of the containment apparatus 200 can advantageously push the lodged materials towards the charging chamber 116 and eliminate "bridging."

Moreover, the containment member 202 can reduce the amount of the material 250 cut by the baling ram 108 moving across the charging chamber 116. As shown in FIG. 3B, when the containment members 202 are in the second position, the cutting apparatus of the baling ram 108 may need to cut the material 250 across the gap 214 ("G') to separate the material 250 in the charging chamber 116 from the rest of the material 250 in the hopper 150. On the other hand, when the containment members 202 are in the first position, the cutting apparatus of the baling ram 108 may need to cut the material 250 across the entire width ("W") of the charging chamber 116. Having less material to cut during the baling process (for example, the baling ram 108 moving across the charging chamber 116) can advantageously require less strokes of the baling ram 108 to separate the material 250 in the charging chamber 116, resulting in an improved baling efficiency and reduced energy consumption. Additionally, such reduction in the width that needs to be cut by the baling ram 108 (e.g., by a knife of the baling ram 108), inhibits the jamming of the knife, which improves reliability of the baling system and reduces down or maintenance time.

The compression force applied by the containment members 202 can improve cutting the material 250 for certain materials. For example, soft materials such as cotton or other types of fabrics may be easier to cut when they are stretched or pulled tight. The compression force applied on the material 250 can advantageously increase tension between the material 250 in the charging chamber 116 and the material 250 not in the charging chamber 116 to make cutting easier at the gap 214.

The containment members 202 in the second position can cause the material 250 in the charging chamber 116 to have greater density than the material 250 not in the charging chamber 116. The compression force generated by the containment member 202 can cause greater amount of the material 250 to be placed in the charging chamber 116 than without the compression force. Therefore, applying compression force using the containment members 202 can advantageously allow the baling machine 100 to bale more of the material 250 per stroke by the baling ram 108.

Optionally, the containment member 202 can have a third position 270 where the containment member 202 compresses the material 250 further towards a bottom surface of the charging chamber, moving beyond the upper boundary 230 of the charging chamber 116. The third position 270 of the containment member 202 is illustrated with the dotted line as shown in FIG. 3B. This can further compress the material 250 and ensure that the material 250 does not "ride up" beyond the upper boundary 230 of the charging chamber 116.

Baling and Ejection

Figure 4A:
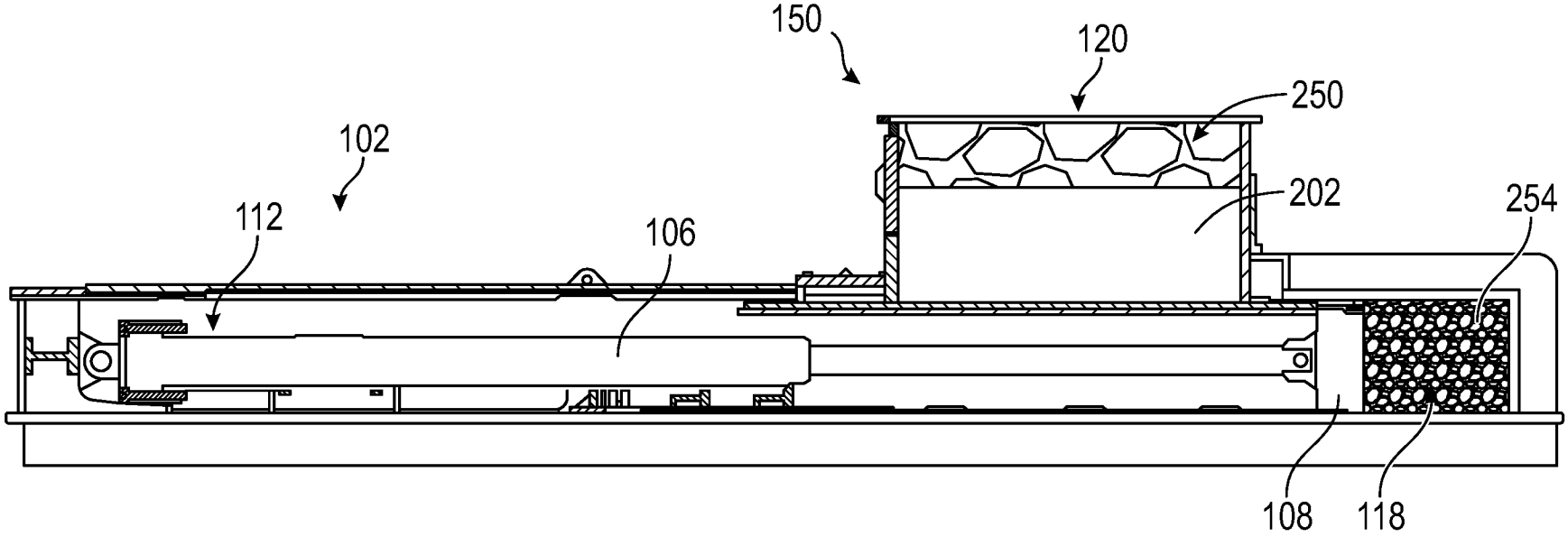
FIGS. 4A and 4B illustrate cross-sectional side and end views of the baling machine of FIG. 1A, showing the material compressed by the baling or gatherer ram into a bale.
Figure 4B:
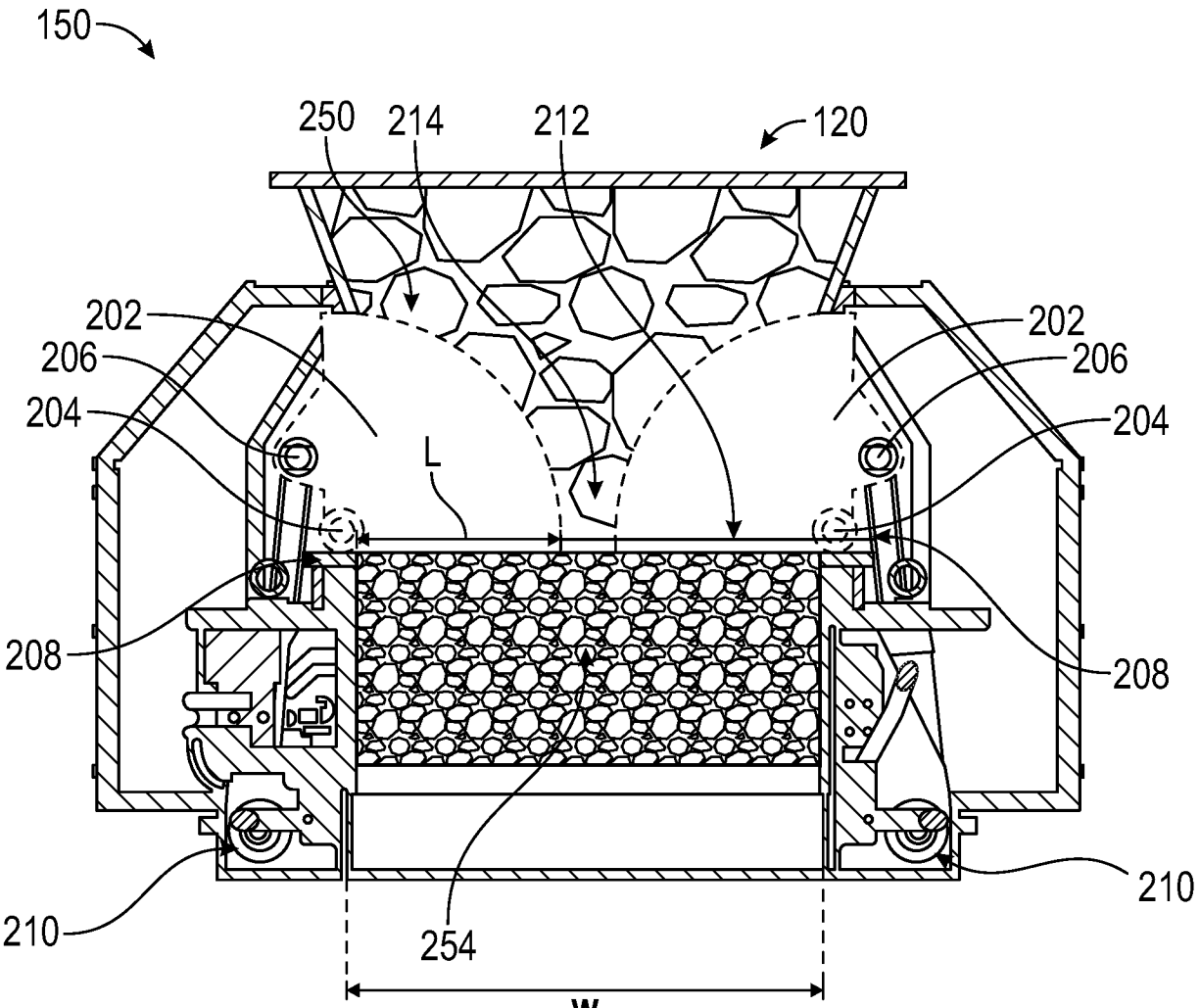

FIGS. 3A and 4A illustrate the baling ram assembly 102 applying compaction force to the material 250 in the charging chamber 116. The baling actuator 106 of the baling ram assembly 102 can apply force to the baling ram 108 to move the baling ram 108 across the charging chamber 116 and towards the compaction chamber 118. The baling ram 108 can have a first position where the baling ram 108 forms a side of the charging chamber 116, as shown in FIG. 3A. The baling can have a second position where the baling ram 108 forms a side of the compaction chamber 118 as shown in FIG. 4A. The ejector ram assembly 122 can be used to eject the bale 254 from the compaction chamber 118. The control system 140 can control operation of the ejector ram assembly 122. By sending signals to ejector actuator 126, the control system 140 can cause the ejector ram 128 to move into the compaction chamber 118 and eject the bale 254 via the exit 190. The ejector ram 128 can have dimensions or cross-section approximate to that of the compaction chamber 118.

Method of Baling

Figure 5:
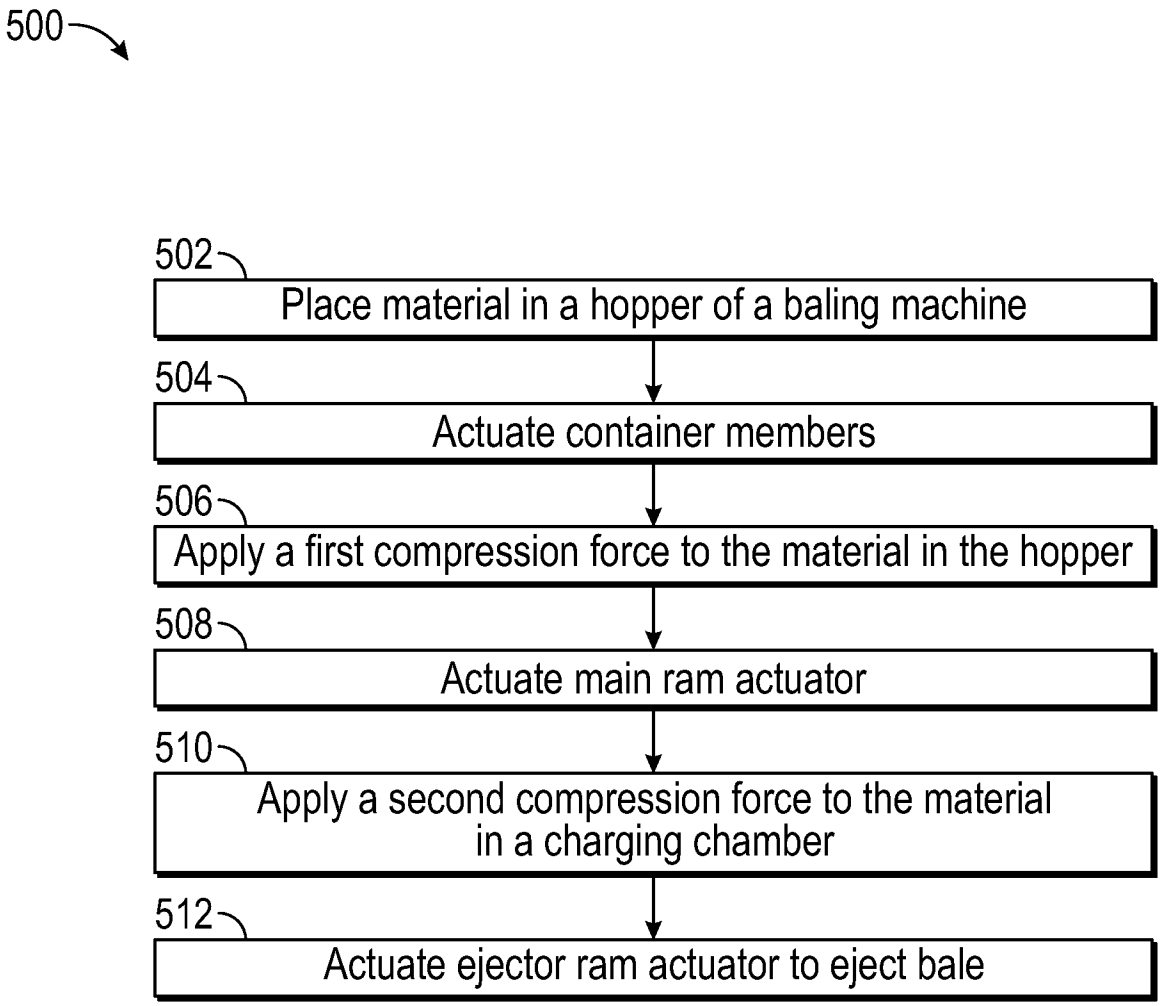
FIG. 5 illustrates a method of operating the baling machine of FIG. 1A.

FIG. 5 illustrates a method 500 of operating the baling machine 100. At block 502, the material 250 can be placed in the hopper through the opening 120. At block 504, the containment member 202 can be actuated by the control system 140. As discussed above, the control system 140 can actuate the containment member 202 by sending signals to the actuator 210, which in turn can linearly or rotationally actuate the containment member 202 via the actuating member 208.

At block 506, the containment member 202 apply compression force to the material 250 in the hopper 150. As discussed above, the compression force applied by the containment member 202 can eliminate "bridging" or "ride up" of the material 250. In addition, the containment member 202 can increase the amount of the material 250 in the charging chamber 116. Moreover, the containment member 202 can reduce the amount of the material 250 cut by the cutting apparatus of the baling ram 108, thereby increasing lifespan of the cutting apparatus.

At block 508, the control system 140 can send signals to the control system 140 to actuate the baling actuator 106 of the baling ram assembly 102. The baling actuator 106 can cause the baling ram 108 to move across the charging chamber 116 and push the material 250 towards the compaction chamber 118. At block 510, the baling ram 108 can apply compaction force to further compress the material 250 in the compaction chamber 118 and manufacture the bale 254.

At block 512, the control system 140 can send signals to the control system 140 to actuate the ejector actuator 126 of the ejector ram assembly 122. The ejector actuator 126 can push and eject the bale 254 from the compaction chamber 118 via the exit 190. Optionally, the bale 254 can be automatically wrapped prior to being ejected from the compaction chamber 118.

Terminology

While certain embodiments of the inventions have been described, these embodiments have been presented by way of example only, and are not intended to limit the scope of the disclosure. Indeed, the novel methods and systems described herein may be embodied in a variety of other forms. Furthermore, various omissions, substitutions and changes in the systems and methods described herein may be made without departing from the spirit of the disclosure. The accompanying claims and their equivalents are intended to cover such forms or modifications as would fall within the scope and spirit of the disclosure. Accordingly, the scope of the present inventions is defined only by reference to the appended claims.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a subcombination.

Moreover, while operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Further, the operations may be rearranged or reordered in other implementations. Those skilled in the art will appreciate that in some embodiments, the actual steps taken in the processes illustrated and/or disclosed may differ from those shown in the figures. Depending on the embodiment, certain of the steps described above may be removed, others may be added. Furthermore, the features and attributes of the specific embodiments disclosed above may be combined in different ways to form additional embodiments, all of which fall within the scope of the present disclosure. Also, the separation of various system components in the implementations described above should not be understood as requiring such separation in all implementations, and it should be understood that the described components and systems can generally be integrated together in a single product or packaged into multiple products.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than 10% of, within less than 5% of, within less than 1% of, within less than 0.1% of, and within less than 0.01% of the stated amount. As another example, in certain embodiments, the terms "generally parallel" and "substantially parallel" refer to a value, amount, or characteristic that departs from exactly parallel by less than or equal to 15 degrees, 10 degrees, 5 degrees, 3 degrees, 1 degree, or 0.1 degree.

The scope of the present disclosure is not intended to be limited by the specific disclosures of preferred embodiments in this section or elsewhere in this specification, and may be defined by claims as presented in this section or elsewhere in this specification or as presented in the future. The language of the claims is to be interpreted broadly based on the language employed in the claims and not limited to the examples described in the present specification or during the prosecution of the application, which examples are to be construed as non-exclusive.

What is claimed is:

1. A baling machine comprising:

a compaction chamber;

a hopper coupled to the compaction chamber, the hopper comprising an opening, a charging chamber, and a containment apparatus, the charging chamber and the compaction chamber defining a cavity with a first cross-section, the containment apparatus comprising:

a first containment member comprising a first surface, the first containment member rotatably coupled to the hopper, the first containment member having a first position and a second position, the first surface of the first containment member being flush with an inner surface of the hopper when the first containment member is in the first position, the first surface of the first containment member being substantially parallel to a bottom surface of the charging chamber when the first containment member is in the second position; and an actuator configured to move the first containment member from the first position to the second position; and a baling ram assembly coupled to the hopper, the baling ram assembly comprising a baling ram and a baling actuator, the baling actuator configured to move the baling ram through the charging chamber and towards the compaction chamber; and an ejector ram assembly coupled to the compaction chamber and comprising an ejector ram and an ejector actuator, the ejector actuator configured to move the ejector ram towards the compaction chamber and eject a bale from the compaction chamber, wherein the first containment member comprises a third position, the first surface of the first containment member positioned beyond the second position and an upper boundary of the charging chamber towards the bottom surface of the charging chamber when the first containment member is in the third position.

2. The baling machine of claim 1, wherein the containment apparatus further comprises a second containment member comprising a second surface and rotatably coupled to the hopper, the second containment member having a first position and a second position, the second surface of the second containment member being flush with the inner surface of the hopper when the second containment member is in the first position, the second surface of the second containment member being substantially parallel to the bottom surface of the charging chamber when the second containment member is in the second position.

3. The baling machine of claim 2, wherein a gap is formed between the first containment member and the second containment member when the first containment member and the second containment members are in the corresponding second positions.

4. The baling machine of claim 1, wherein a cross-section the baling ram is the same as the first cross-section of the cavity.

5. The baling machine of claim 1, wherein the ejector ram defines a first axis and the baling ram defines a second axis, the first axis being orthogonal to the second axis.

6. The baling machine of claim 1, wherein the charging chamber and the ejector ram have the same cross-section.

7. The baling machine of claim 1, wherein the baling actuator moves the baling ram from a first position to a second position, the baling ram forming a side of the charging chamber in the first position, and the baling ram forming a side of the compaction chamber in the second position.

8. The baling machine of claim 1, wherein the hopper is positioned between the compaction chamber and the baling ram assembly.

9. The baling machine of claim 3, wherein the baling ram is configured to cut material extending through the gap between the containment apparatus and the charging chamber.

10. A baling machine comprising:

a compaction chamber;

a hopper coupled to the compaction chamber, the hopper comprising an opening, a charging chamber, and a containment apparatus, the charging chamber and the compaction chamber defining a cavity with a first cross-section, the containment apparatus comprising:

a first containment member comprising a first surface, the first containment member rotatably coupled to the hopper, the first surface of the first containment member being flush with an inner surface of the hopper when the first containment member is in a first position; and an actuator configured to move the first containment member from the first position to a second position and thereby applying a first compression force, the first surface of the first containment member being substantially parallel to a bottom surface of the charging chamber when the first containment member is in the second position; and a baling ram assembly coupled to the hopper, the baling ram assembly comprising a baling ram and a baling actuator, the baling actuator configured to move the baling ram into the charging chamber and apply a second compression force; and an ejector ram assembly coupled to the compaction chamber and comprising an ejector ram and an ejector actuator, the ejector actuator configured to move the ejector ram into the compaction chamber and eject a bale from the compaction chamber, wherein the first containment member comprises a third position, the first surface of the first containment member positioned beyond the second position and an upper boundary of the charging chamber towards the bottom surface of the charging chamber when the first containment member is in the third position.

11. The baling machine of claim 10, wherein the ejector ram defines a first axis and the baling ram defines a second axis, the first axis being orthogonal to the second axis.

12. The baling machine of claim 10, wherein the containment apparatus further comprises a second containment member comprising a second surface and rotatably coupled to the hopper, the second containment member having a first position and a second position, the second surface of the second containment member being flush with the inner surface of the hopper when the second containment member is in the first position, the second surface of the second containment member being substantially parallel to the bottom surface of the charging chamber when the second containment member is in the second position.

13. The baling machine of claim 12, wherein a gap is formed between the first containment member and the second containment member when the first containment member and the second containment members are in the second position.

14. The baling machine of claim 10, wherein the hopper is positioned between the compaction chamber and the baling ram assembly.

15. The baling machine of claim 13, wherein the baling ram is configured to cut material extending through the gap between the containment apparatus and the charging chamber.

16. A baling machine comprising:

a hopper defining an opening in communication with a charging chamber below the hopper;

a baling ram actuatable to slidably move across the charging chamber; and a pair of pivotable doors each having a substantially planar surface, the pair of pivotable doors configured to move between a retracted position and a deployed position, the pair of pivotable doors in the retracted position being generally upright and defining at least a portion of sidewalls of the hopper to allow communication between the opening and the charging chamber, the pair of pivotable doors in the deployed position being generally horizontal and configured to apply a compression force to material introduced through the hopper into the charging chamber, the pair of pivotable doors in the deployed position containing the material in the charging chamber, wherein the pair of pivotable doors comprise a compressing position, the pair of pivotable doors positioned beyond the deployed position and an upper boundary of the charging chamber towards a bottom surface of the charging chamber when the pair of pivotable doors are in the compressing position.

17. The baling machine of claim 16, wherein the baling ram is configured to charging chamber and apply a compression force to the material in the charging chamber to form a bale.

18. The baling machine of claim 17, the baling machine further comprising a compaction chamber, and the baling machine further comprising an ejector ram configured to slidably move across the compaction chamber to eject the bale formed by the baling ram.

19. The baling machine of claim 16, wherein a gap is formed between the pair of pivotable doors when the pair of pivotable doors are in the deployed position.

20. The baling machine of claim 19, wherein the baling ram is configured to cut material extending through the gap between the hopper and the charging chamber.

* * * * *